US007628473B2

(12) United States Patent
Onozawa

(10) Patent No.: US 7,628,473 B2
(45) Date of Patent: Dec. 8, 2009

(54) LIQUID EJECTION APPARATUS, LIQUID EJECTION METHOD AND IMAGE FORMING APPARATUS

(75) Inventor: Sho Onozawa, Kanagawa-ken (JP)

(73) Assignee: FUJIFILM Corporation, Minato-ku, Tokyo (JP)

( * ) Notice: Subject to any disclaimer, the term of this patent is extended or adjusted under 35 U.S.C. 154(b) by 266 days.

(21) Appl. No.: 11/898,316

(22) Filed: Sep. 11, 2007

(65) Prior Publication Data

US 2008/0062227 A1 Mar. 13, 2008

(30) Foreign Application Priority Data

Sep. 12, 2006 (JP) ..... 2006-246701

(51) Int. Cl.
*B41J 2/045* (2006.01)

(52) U.S. Cl. ..... 347/68

(58) Field of Classification Search ..... 347/68, 347/69–72, 62–65, 54, 56, 46, 9, 14–15, 347/76, 77; 400/124.1
See application file for complete search history.

(56) References Cited

U.S. PATENT DOCUMENTS

2003/0156169 A1* 8/2003 Martin et al. ..... 347/77
2007/0273731 A1* 11/2007 Young et al. ..... 347/68

FOREIGN PATENT DOCUMENTS

JP 2004-66531 A 3/2004

* cited by examiner

*Primary Examiner*—K. Feggins
(74) *Attorney, Agent, or Firm*—Birch, Stewart, Kolasch & Birch, LLP

(57) ABSTRACT

The liquid ejection apparatus includes: a pressure chamber which contains liquid; a nozzle which is connected to the pressure chamber, the liquid being ejected in an ejection direction through the nozzle; a piezoelectric element which applies pressure change to the liquid in the pressure chamber, a part of the liquid protruding from the nozzle upon the pressure change and growing into a column of the liquid having a longitudinal direction parallel with the ejection direction; an electrode which induces a charge on a surface of the column of the liquid; and a voltage control device which controls voltage applied to the electrode, the voltage control device reversing polarity of the electrode when the column of the liquid has grown to a prescribed length.

5 Claims, 5 Drawing Sheets

51
60
62
64
66
68
120
120a

LIQUID EJECTION APPARATUS, LIQUID EJECTION METHOD AND IMAGE FORMING APPARATUS

BACKGROUND OF THE INVENTION

1. Field of the Invention

The present invention relates to a liquid ejection apparatus, a liquid ejection method and an image forming apparatus, and more particularly, to a liquid ejection apparatus which ejects liquid through nozzles connected to pressure chambers by applying pressure change to the liquid inside the pressure chambers by using the displacement of piezoelectric elements.

2. Description of the Related Art

There is known a recording head used in an inkjet recording apparatus that ejects droplets of ink through nozzles connected to pressure chambers by applying pressure change to the ink inside the pressure chambers by using the displacement of piezoelectric elements. In a recording head based on this piezoelectric method, and in particular when using an ink of high viscosity, a phenomenon referred to as "trailing" is liable to occur in which the ink droplet ejected from a nozzle forms a column shape and trails during its flight. This can give rise to minute ink droplets referred to as "satellite droplets" accompanying the main ink droplet, which degrade the image quality.

In order to resolve problems of this kind, as one means of preventing excessive elongation of the liquid column, for example, it has been considered that the surface tension of the liquid is raised to increase the speed of growth of the initial necking, in such a manner that the ligament separates off at an early stage from a main droplet portion having acquired momentum; however, in actual practice, the surface tensions of non-metallic liquids are limited to approximately 70 mN/m, which is the surface tension of water. Moreover, in practical terms, if the surface tension is excessively raised, then the actuator power required to break the free surface (also referred to as the "meniscus") of the liquid inside the nozzle increases, and further problems occur in relation to the permeability of the liquid into the recording medium after landing of the liquid droplets on the recording medium. Furthermore, it may be thought that conditions can be optimized to ensure that the liquid column is ejected without excessive elongation, by reducing the ejection pressure to a limit value at which the main droplet portion breaks off before the free surface of the liquid is pulled back into the nozzle due to the surface tension acting on the liquid column; however in this case, the ejection speed is reduced and in the case of fine liquid droplets in particular, it is difficult to deposit the droplets onto the recording medium due to air resistance.

On the other hand, Japanese Patent Application Publication No. 2004-066531 discloses that the free surface of charged ink is deformed into a thread shape by means of a first electrode disposed in a position opposing the nozzle, and the front end portion of the free surface of the ink that has been deformed into the thread shape is severed by means of a second electrode disposed between the nozzle and the first electrode.

Japanese Patent Application Publication No. 2004-066531 assumes the use of a recording apparatus of a continuous inkjet (CIJ) type, and supposes that the free surface of the ink is formed into the thread shape; however, in a recording apparatus of a drop on demand (DOD) type, which is typical in a piezoelectric system, the principal focus is on preventing the occurrence of satellite droplets by restricting elongation of the liquid column, and it is difficult to apply the composition described in Japanese Patent Application Publication No. 2004-066531 to the recording head that uses the piezoelectric method. This is because in the piezoelectric type of recording head, in order to prevent satellite droplets, it is necessary to suppress the thread shape (the trail of the liquid column), as much as possible, but if the electrode composition according to Japanese Patent Application Publication No. 2004-066531 is combined with the piezoelectric type of recording head, then the pulling electrode in the vicinity of the target continues to pull on the liquid column and it is impossible to avoid elongation of the liquid column.

Moreover, in Japanese Patent Application Publication No. 2004-066531, the actions of driving (electrostatic pulling action), charging and severing are each carried out using different electric fields, and therefore significant cross-talk between the electric fields is expected. In particular, in a multi-nozzle composition, there are concerns regarding the effects of electric field cross-talk between the nozzles. Furthermore, if high voltages are applied to the respective electrodes, then there is a risk of electrical breakdown between the electrodes.

SUMMARY OF THE INVENTION

The present invention has been contrived in view of these circumstances, an object thereof being to provide a liquid ejection apparatus, a liquid ejection method and an image forming apparatus whereby liquid of high viscosity can be ejected without giving rise to satellite droplets.

In order to attain the aforementioned object, the present invention is directed to a liquid ejection apparatus, comprising: a pressure chamber which contains liquid; a nozzle which is connected to the pressure chamber, the liquid being ejected in an ejection direction through the nozzle; a piezoelectric element which applies pressure change to the liquid in the pressure chamber, a part of the liquid protruding from the nozzle upon the pressure change and growing into a column of the liquid having a longitudinal direction parallel with the ejection direction; an electrode which induces a charge on a surface of the column of the liquid; and a voltage control device which controls voltage applied to the electrode, the voltage control device reversing polarity of the electrode when the column of the liquid has grown to a prescribed length.

According to this aspect of the present invention, during the liquid ejection, the electric charge is induced in the surface of the liquid column formed to the long and thin column shape extending in the ejection direction from the nozzle, by means of the electric field generated by the electrode, and by reversing the polarity of the electrode when the liquid column has grown to the prescribed length, the liquid surface and the electrode assume the same polarity, and severing force acts in the contrary directions on the front end portion and the rest of the liquid column, whereby the front end portion of the liquid column can be severed. By separating the main droplet corresponding to the front end portion of the liquid column by cutting off the liquid ligament by means of the electrostatic field, it is possible to eject the droplet of ink of high viscosity without giving rise to satellite droplets, regardless of the surface tension of the ink or the ejection speed.

Preferably, the electrode is composed of a plate arranged over the nozzle and having a hole in a position corresponding to the nozzle, the hole having a tapered shape becoming gradually narrower along the ejection direction.

According to this aspect of the present invention, the taper-shaped hole sections that become gradually narrower along the ejection direction are formed in the electrode, in positions corresponding to the nozzles. Hence, the front end portion of the liquid column can be severed efficiently.

In order to attain the aforementioned object, the present invention is also directed to an image forming apparatus comprising the above-described ejection apparatus.

In order to attain the aforementioned object, the present invention is also directed to a liquid ejection method comprising the steps of: applying pressure change to liquid in a pressure chamber by using displacement of a piezoelectric element, a part of the liquid protruding from a nozzle connected to the pressure chamber upon the pressure change and growing into a column of the liquid having a longitudinal direction parallel with an ejection direction in which the liquid is ejected through the nozzle; applying a prescribed voltage to an electrode to induce a charge on a surface of the column of the liquid; and reversing polarity of the electrode when the column of the liquid has grown to a prescribed length.

According to the present invention, during liquid ejection, electric charge is induced in a surface of a liquid column formed to a long and thin column shape extending in an ejection direction from a nozzle, by means of an electric field generated by an electrode, and by reversing the polarity of the electrode when the liquid column has grown to a prescribed length, the liquid surface and the electrode assume the same polarity, and severing force acts in the contrary directions on a front end portion and the rest of the liquid column, whereby the front end portion of the liquid column can be severed. By separating the main droplet corresponding to the front end portion of the liquid column by cutting off the liquid ligament by means of the electrostatic field, it is possible to eject the droplet of ink of high viscosity without giving rise to satellite droplets, regardless of the surface tension of the ink or the ejection speed.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
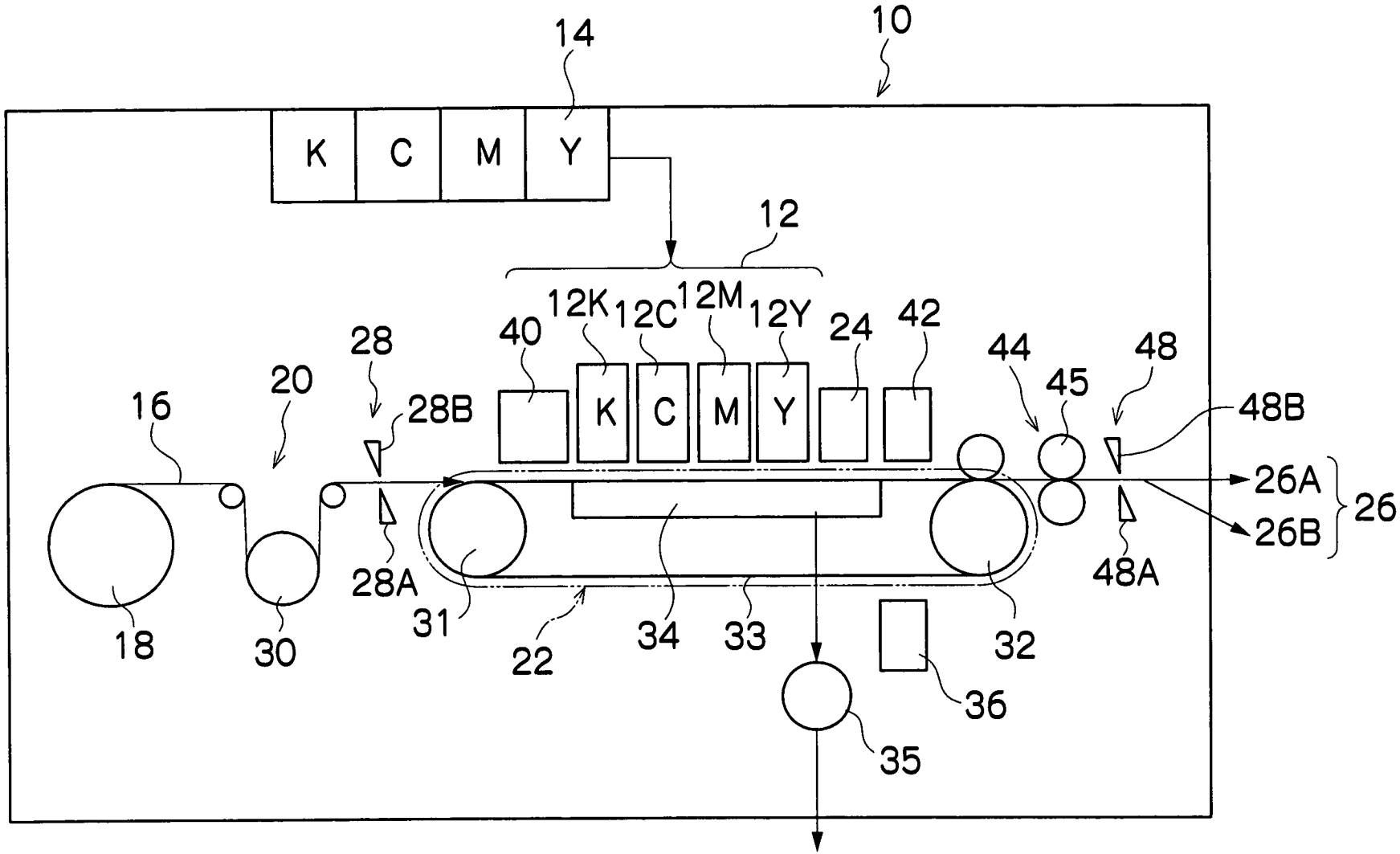
FIG. 1 is a schematic drawing showing a general view of an inkjet recording apparatus.

FIG. 1 is a general schematic drawing of an inkjet recording apparatus which is an image recording apparatus according to an embodiment of the present invention. As shown in FIG. 1, the inkjet recording apparatus 10 includes: a printing unit 12 having a plurality of recording heads 12K, 12C, 12M, and 12Y for ink colors of black (K), cyan (C), magenta (M), and yellow (Y), respectively; an ink storing and loading unit 14, which stores inks of K, C, M and Y to be supplied to the recording heads 12K, 12C, 12M, and 12Y; a paper supply unit 18, which supplies recording paper 16; a decurling unit 20, which removes curl in the recording paper 16; a suction belt conveyance unit 22, which is disposed facing the nozzle face (ink-droplet ejection face) of the print unit 12 and conveys the recording paper 16 while keeping the recording paper 16 flat; a print determination unit 24, which reads the printed result produced by the printing unit 12; and a paper output unit 26, which outputs image-printed recording paper (printed matter) to the exterior.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of the configuration in which roll paper is used, a cutter 28 is provided as shown in FIG. 1, and the continuous paper is cut into a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut papers are used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite to the curl direction in the magazine. In this, the heating temperature is preferably controlled in such a manner that the medium has a curl in which the surface on which the print is to be made is slightly rounded in the outward direction.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a plane.

The belt 33 has a width that is greater than the width of the recording paper 16, and a plurality of suction restrictors (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and a negative pressure is generated by sucking air from the suction chamber 34 by means of a fan 35, thereby the recording paper 16 on the belt 33 is held by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can include a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

The print unit 12 is a so-called "full line head" in which a line head having a length corresponding to the maximum paper width is arranged in a direction (main scanning direction) that is perpendicular to the paper conveyance direction (sub-scanning direction). The recording heads 12K, 12C, 12M and 12Y forming the print unit 12 are constituted by line heads in which ink ejection ports (nozzles) are arranged through a length exceeding at least one edge of the maximum size recording paper 16 intended for use with the inkjet recording apparatus 10.

The recording heads 12K, 12C, 12M, 12Y corresponding to respective ink colors are disposed in the order, black (K), cyan (C), magenta (M) and yellow (Y), from the upstream side (left-hand side in FIG. 1), following the direction of conveyance of the recording paper 16 (the paper conveyance direction). A color image can be formed on the recording paper 16 by ejecting the inks from the recording heads 12K, 12C, 12M, and 12Y, respectively, onto the recording paper 16 while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relative to each other in the paper conveyance direction (sub-scanning direction) just once (in other words, by means of a single sub-scan). Higher-speed printing is thereby made possible and productivity can be improved in comparison with a shuttle type head configuration in which a recording head moves reciprocally in a direction (main-scanning direction) that is perpendicular to paper conveyance direction.

Although a configuration with the four standard colors KCMY is described in the present embodiment, the combinations of the ink colors and the number of colors are not limited to these, and light and/or dark inks can be added as required. For example, a configuration is possible in which recording head for ejecting light-colored inks such as light cyan and light magenta are added.

As shown in FIG. 1, the ink storing and loading unit 14 has ink tanks for storing the inks of the colors corresponding to the respective recording heads 12K, 12C, 12M, and 12Y, and the respective tanks are connected to the recording heads 12K, 12C, 12M, and 12Y by means of channels (not shown). The ink storing and loading unit 14 has a warning device (for example, a display device, an alarm sound generator, or the like) for warning when the remaining amount of any ink is low, and has a mechanism for preventing loading errors among the colors.

The print determination unit 24 has an image sensor (line sensor and the like) for capturing an image of the ink-droplet deposition result of the printing unit 12, and functions as a device to check for ejection defects such as clogs of the nozzles in the printing unit 12 from the ink-droplet deposition results evaluated by the image sensor.

The print determination unit 24 of the present embodiment is constituted with at least a line sensor having rows of photoelectric transducing elements with a width that is greater than the ink-droplet ejection width (image recording width) of the recording heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the recording heads 12K, 12C, 12M, and 12Y for the respective colors, and the ejection of each recording head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is output from the paper output unit 26. The target print (i.e., the result of printing the target image) and the test print are preferably output separately. In the inkjet recording apparatus 10, a sorting device (not shown) is provided for switching the outputting pathways in order to sort the printed matter with the target print and the printed matter with the test print, and to send them to paper output units 26A and 26B, respectively.

When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in the drawings, the paper output unit 26A for the target prints is provided with a sorter for collecting prints according to print orders.

Next, the composition of the recording heads 12K, 12C, 12M and 12Y is described. The recording heads 12K, 12C, 12M and 12Y of the respective ink colors have the same composition, and a reference numeral 50 is hereinafter used to designate a representative example of the recording heads.

Figure 2:
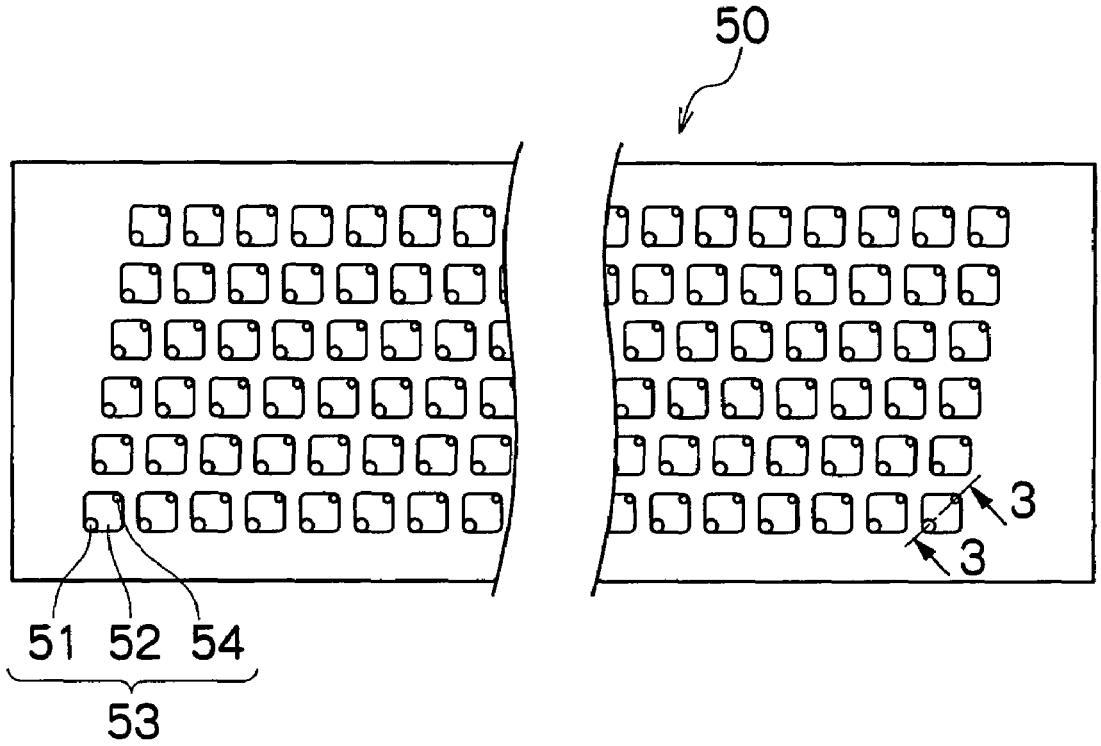
FIG. 2 is a plan view perspective diagram showing an example of the composition of a recording head.

FIG. 2 is a plan view perspective diagram showing the example of the structure of a recording head 50. As shown in FIG. 2, the recording head 50 has a structure in which a plurality of ink chamber units (liquid droplet ejection elements) 53, each comprising a nozzle 51, a pressure chamber 52, and a supply port 54, are arranged in a (two-dimensional) staggered matrix configuration, in such a manner that the nozzles 51 are arranged at high density at a uniform nozzle pitch when projected to an alignment in the lengthwise direction of the head (the direction perpendicular to the paper conveyance direction). Thereby, it is possible effectively to achieve a high density of the dot pitch, and to form images of high quality.

The pressure chamber 52 provided corresponding to each of the nozzles 51 is approximately square-shaped in plan view, and a nozzle 51 and a supply port 54 are provided respectively at either corner of a diagonal of the pressure chamber 52.

Figure 3:
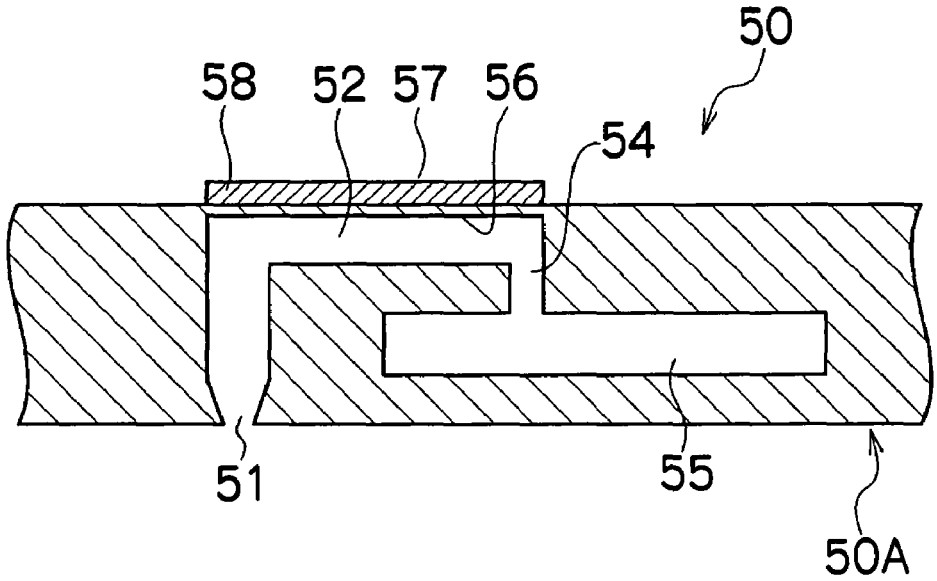
FIG. 3 is a cross-sectional diagram along line 3-3 in FIG. 2 for showing an approximate view of a portion of the recording head.

FIG. 3 is a cross-sectional view along line 3-3 in FIG. 2, and shows an approximate view of one portion of the recording head 50. As shown in FIG. 3, the nozzle 51 and the pressure chamber 52 are connected to each other, and ink for ejecting from the nozzle 51 is filled into the pressure chamber 52. A supply port 54 is formed at one end of each pressure chamber 52, and the pressure chamber 52 is connected to a common flow channel 55 through the supply port 54. Ink supplied from an ink tank (not shown) which forms an ink supply source is temporarily accumulated in the common flow channel 55, and is then distributed to the respective pressure chambers 52.

One wall of the pressure chamber 52 is constituted by a diaphragm 56, and a piezoelectric element 58 provided with an individual electrode 57 is disposed on the diaphragm 56 at a position corresponding to the pressure chamber 52 (in other words, at a position facing the pressure chamber 52 across the diaphragm 56). A piezoelectric body is suitable as the piezoelectric element 58. The diaphragm 56 also serves as a common electrode for the piezoelectric elements 58.

Figure 4:
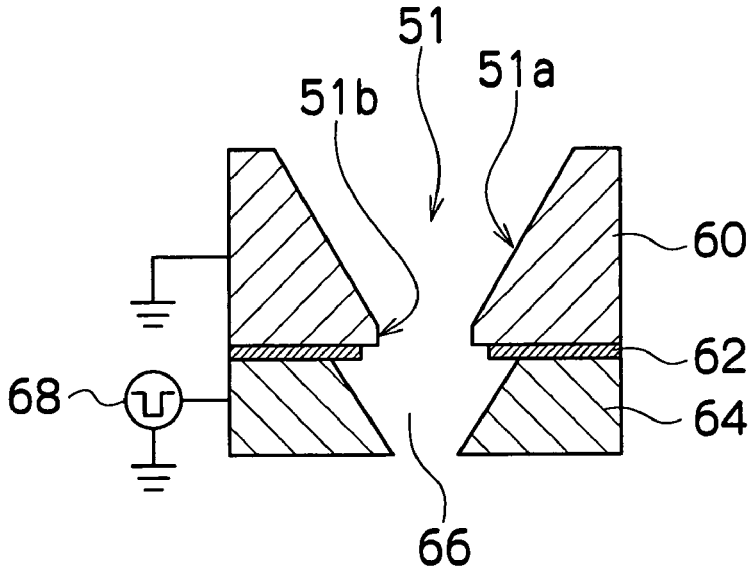
FIG. 4 is an enlarged cross-sectional diagram showing the detailed structure of the peripheral portion of a nozzle.

Next, the structure of the peripheral region of the nozzle, which is the characteristic portion of the present invention, is described. FIG. 4 is an enlarged cross-sectional diagram showing the detailed structure of the peripheral portion of one of the nozzles 51.

As shown in FIG. 4, the nozzles 51 are formed in a nozzle plate 60. Each nozzle 51 has a tapered and straight shape constituted of a tapered section 51*a*, which becomes gradually narrower along the ink ejection direction (i.e., the downward direction in FIG. 4), and a straight section 51*b*, which is connected to the front end part (i.e., the minimum diameter part) of the tapered section 51*a*. By adopting a nozzle shape of this kind, it is possible to achieve stable ejection by suppressing variations in ejection direction.

A plate-shaped electrode 64 is bonded to the ink ejection side of the nozzle plate 60 across an insulating layer 62. Tapered hole sections 66, which become gradually narrower along the ink ejection direction, are formed in the electrode plate 64 in positions corresponding to the nozzles 51. Hence, when ejecting ink, a column of the liquid (the ink) formed in a long and thin column shape extending along the ink ejection direction from the nozzle 51 is able to pass through the hole section 66 without making contact with the plate-shaped electrode 64. Although not shown in particular in the drawings, the plate-shaped electrode 64 is composed in a plate shape covering the whole of the region in which the nozzles 51 shown in FIG. 2 are formed, and the hole sections 66 are formed in the electrode 64 at the positions corresponding to the respective nozzles 51. Instead of thus covering the plurality of nozzles 51 with the common plate-shaped electrode 64, it is also possible that the nozzles 51 are respectively provided with independent electrodes.

The plate-shaped electrode 64 is arranged in order to induce a charge on the surface of the liquid column by means of an electric field generated from the plate-shaped electrode 64 while the liquid column protrudes from the nozzle 51 and grows until assuming a prescribed length, and then, by reversing the polarity of the plate-shaped electrode 64 when the liquid column has reached the prescribed length, the front end portion of the liquid column is severed from the rest of the liquid column by means of the resulting severing force acting on the liquid column. Therefore, a variable power source 68 is connected to the plate-shaped electrode 64, in such a manner that a prescribed voltage can be applied to the plate-shaped electrode 64 from the variable power source 68. Furthermore, in the present embodiment, ink having chargeable properties is used, and the nozzle plate 60 is made of a metal member, in order to promote the draw of the charge into the ink.

The shape of the hole sections 66 is not limited to the tapered shape as in the present embodiment, and it is also possible that the hole sections 66 have, for instance, a straight shape, a flared shape, a curved shape, a constricted shape, or the like, as long as the liquid columns can pass through the hole sections 66. However, from the viewpoint of efficiently severing the front end portions of the liquid columns, it is desirable that the hole sections 66 are formed to the tapered shape.

Figure 5A:
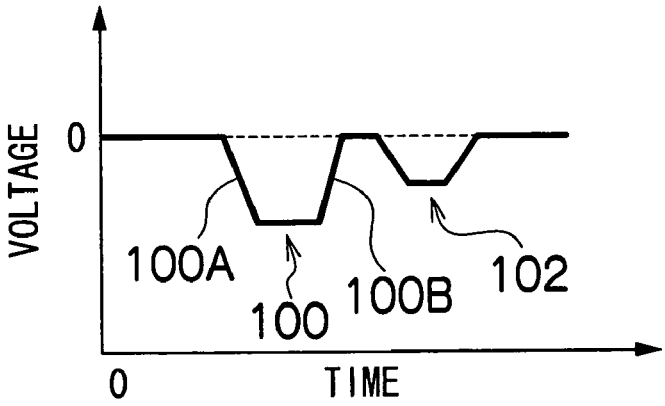
FIGS. 5A and 5B are waveform diagrams showing waveforms of voltage applied to a piezoelectric element and a plate-shaped electrode.
Figure 5B:
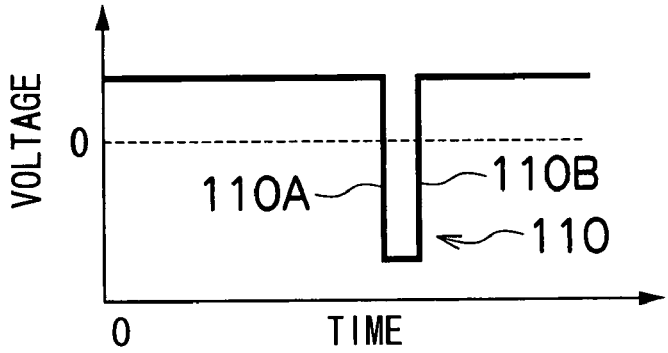
Figures 6A, 6B, 6C:
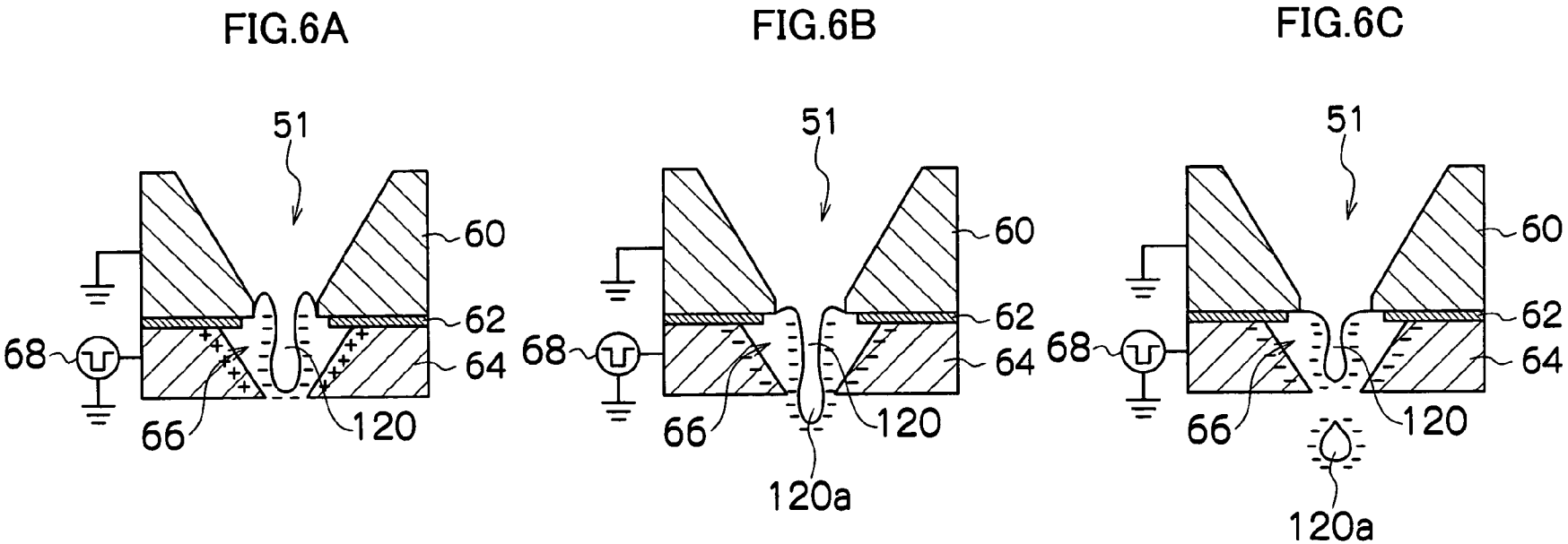
FIGS. 6A to 6C are illustrative diagrams showing an aspect of an ink droplet being ejected from the nozzle.

FIGS. 5A and 5B are waveform diagrams showing waveforms of voltage applied to the piezoelectric element 58 (more specifically, to the individual electrode 57) and the plate-shaped electrode 64, wherein FIG. 5A shows voltage applied to the piezoelectric element 58, and FIG. 5B shows voltage applied to the plate-shaped electrode 64. FIGS. 6A to 6C are illustrative diagrams showing the aspect of an ink droplet being ejected from the nozzle 51. Below, the specific control method according to the present embodiment is described with reference to these drawings.

Firstly, when a pulse of a waveform (a first waveform pulse) 100 shown in FIG. 5A is applied to the individual electrode 57 of the piezoelectric element 58, then the piezoelectric element 58 contracts due to a dropping waveform 100A, thereby increasing the volume of the pressure chamber 52 and supplying the ink inside the common flow channel 55 to the pressure chamber 52 through the supply port 54. In this case, the ink surface in the nozzle 51 is significantly pulled in toward the inner side of the nozzle 51 (in other words, to the pressure chamber 52 side of the nozzle 51). Thereupon, the piezoelectric element 58 expands due to a rising waveform 100B, thereby reducing the volume of the pressure chamber 52 and pressurizing the ink inside the pressure chamber 52.

Consequently, as shown in FIG. 6A, the long and thin column of the liquid (the ink column) 120 is formed in the ejection direction from the nozzle 51.

As shown in FIGS. 5B and 6A, while the liquid column 120 is growing to the prescribed length, and more specifically, until the liquid column 120 assumes the shape shown in FIG. 6B (in other words, a state where a front end portion 120*a* of the liquid column 120 is projecting over the hole section 66), the potential of the plate-shaped electrode 64 is positive due to the voltage applied by the variable power source 68, whereas the potential of the surface of the liquid column 120 is negative due to a charge induced by the electric field generated by the plate-shaped electrode 64.

Then, as shown in FIG. 6B, the polarity of the plate-shaped electrode 64 is reversed when the liquid column 120 has grown to the prescribed length. In other words, the potential of the plate-shaped electrode 64 is changed from positive to negative by means of a dropping waveform 110A in a pulse waveform 110 shown in FIG. 5B. It is desirable that the polarity of the plate-shaped electrode 64 is reversed in a short period of time. The surface of the liquid column 120 and the plate-shaped electrode 64 thereby assume the same polarity, and a severing force acts on the liquid column 120 in the longitudinal direction thereof, due to the electric field generated by the plate-shaped electrode 64. In particular, a strong severing force acts on the liquid column 120 in contrary directions, at the part where the surface of the liquid column 120 and the plate-shaped electrode 64 are closest to each other, in other words, at the ink ejection-side opening of the taper-shaped hole section 66, at which the hole section 66 has the minimum diameter, and consequently the front end portion 120*a* of the liquid column 120 is severed from the rest of the liquid column 120, as shown in FIG. 6C. Thereupon, the polarity of the plate-shaped electrode 64 is reversed again by means of a rising waveform 110B of the first waveform pulse 110, and the potential of the plate-shaped electrode 64 is returned to its initial state (the positive potential). The timing at which the rising waveform 110B is applied is determined in accordance with the ejection characteristics, the ink characteristics, and the like.

As shown in FIG. 5A, it is desirable that after the first waveform pulse 100 has been applied to the piezoelectric element 58, a second waveform pulse 102 having a prescribed potential difference is applied to the piezoelectric element 58. It is thereby possible to effectively suppress residual vibrations of the ink inside the pressure chambers 52 caused by the ink ejection.

In this way, the front end portion 120*a*, which becomes the main droplet, is rapidly separated from the liquid column 120 by reversing the polarity of the plate-shaped electrode 64 when the liquid column 120 has reached the prescribed length, and it is therefore possible to eject ink of high viscosity without giving rise to satellite droplets, regardless of the surface tension of the ink or the ejection speed.

In the present embodiment, the nozzle plate 60 is made of metal and also serves as the electrode for drawing the charge into the ink; however, the implementation of the present invention is not limited to this, and it is also possible to arrange a charge drawing electrode on a wall surface of the nozzle 51 (or the flow channel connected to the nozzle 51) that makes contact with the ink. If the nozzle plate 60 also serves as the charge drawing electrode as in the present embodiment, then it is necessary to determine factors such as the material and thickness of the insulating layer 62 in order not to form a short circuit due to electrical breakdown between the nozzle plate 60 and the plate-shaped electrode 64.

Moreover, when ejecting very fine droplets, in order to prevent decline in the deposition accuracy of the very fine droplets due to air resistance, it is possible to apply a prescribed electric field between the head and the target (namely, between the nozzle 51 and the recording medium), as a means of assisting the flight of the main droplet, which has severed from the liquid column 120.

Furthermore, the present embodiment has been described with reference to the case where the polarity of the plate-shaped electrode 64 is reversed from positive (in FIG. 6A) to negative (in FIGS. 6B and 6C); however, the implementation of the present invention is not limited to this, and a mode is also possible in which the polarities of the respective sections are the opposite of those shown in FIGS. 6A to 6C.

As described above, during ink ejection, the surface of the liquid column 120 that has been formed to the long and thin column shape extending in the ejection direction from the nozzle 51 is induced with the electric charge by means of the electric field generated from the plate-shaped electrode 64, and by reversing the polarity of the plate-shaped electrode 64 when the liquid column 120 has grown to the prescribed length, the surface of the liquid column 120 and the plate-shaped electrode 64 assume the same polarity, and a severing force acts on the liquid ligament between the front end portion 120*a* of the liquid column 120 and the rest of the liquid column 120 in the contrary directions, thereby making it possible to sever off the front end portion 120*a* of the liquid column 120. In particular, it is possible achieve an efficient severing action by forming the hole section 66 in the tapered shape. In this way, it is possible to rapidly separate off the main droplet, which corresponds to the front end portion 120*a* of the liquid column 120, by cutting off the liquid ligament by means of the electrostatic field.

Moreover, since the charging and severing of the liquid column 120 are performed by controlling the voltage applied to only one electrode (the plate-shaped electrode 64), then in comparison with a case where a plurality of electrodes are used, the composition and the control procedure are simplified, there is no risk of electrical breakdown between the electrodes when using a high voltage, and the effects of electric field cross-talk between the electrodes is eliminated. Furthermore, in the present embodiment, since the piezoelectric element 58 is used as the ejection device, there are no effects of electric field cross-talk between the nozzles as in a case where ejection is performed by means of an electrostatic attraction, and therefore it is possible readily to achieve multiple nozzle operation.

Furthermore, since the nozzle 51 is provided with the plate-shaped electrode 64 as the severing electrode in the vicinity of the surface of the liquid in the nozzle 51, then the main droplet portion is rapidly separated from the liquid column by this electrode at the timing in accordance with the shape of the liquid column, and therefore the liquid column itself does not continue to trail until being deposited on the medium. Consequently, it is possible to avoid a situation where the liquid column becomes elongated when the electrode structure described in Japanese Patent Application Publication No. 2004-066531 is combined with a piezoelectric type of recording head.

Figure 7:
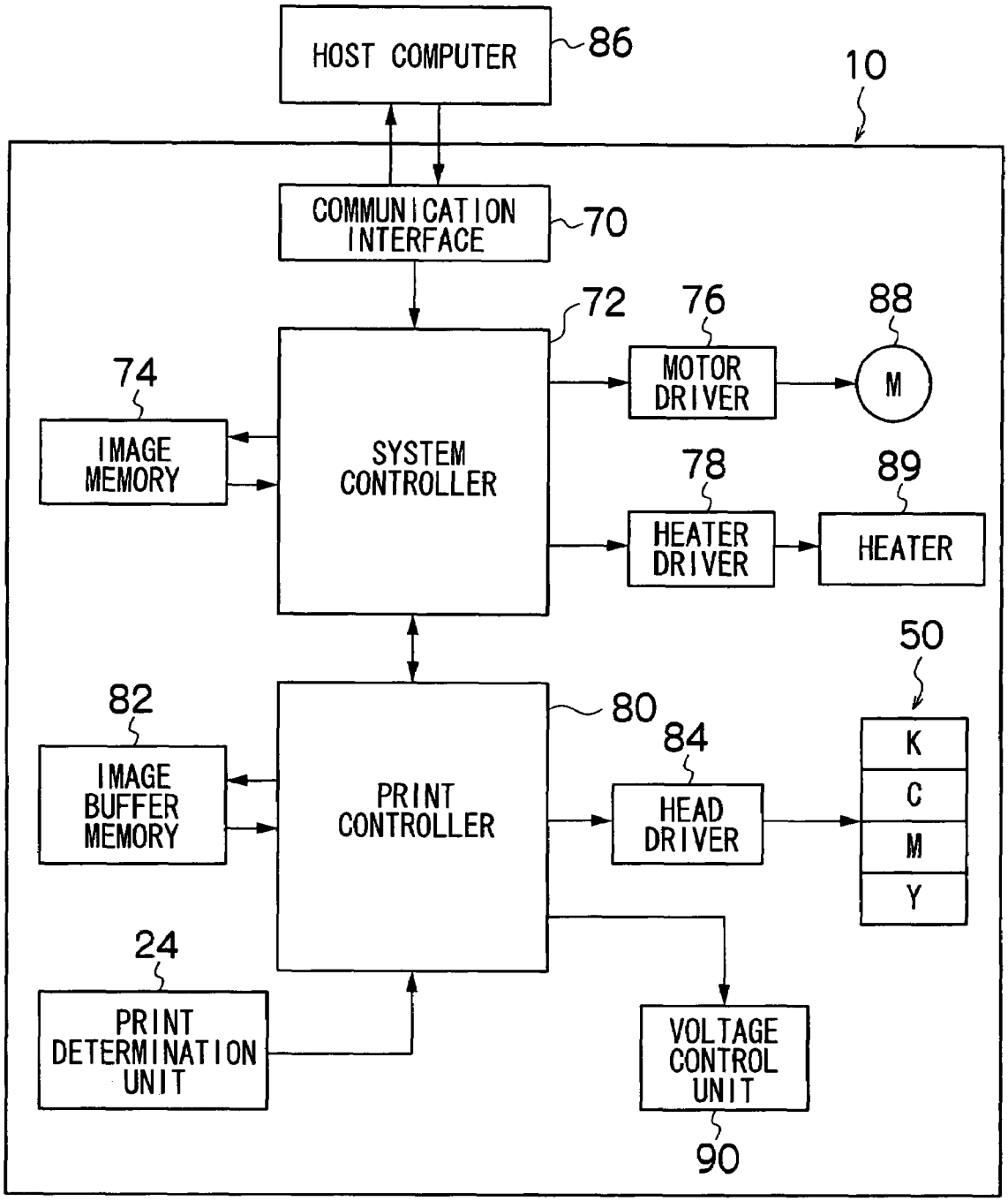
FIG. 7 is a principal block diagram showing the system composition of the inkjet recording apparatus.

Next, the control system of the inkjet recording apparatus 10 is described. FIG. 7 is a principal block diagram showing the system configuration of the inkjet recording apparatus 10. The inkjet recording apparatus 10 includes a communication interface 70, a system controller 72, an image memory 74, a motor driver 76, a heater driver 78, a print controller 80, an image buffer memory 82, a head driver 84, a voltage control unit 90, and the like.

The communication interface 70 is an interface unit for receiving image data transmitted by a host computer 86. A serial interface or a parallel interface may be used for the communication interface 70. It is also possible that the communication interface 70 is provided with a buffer memory (not illustrated) for achieving high-speed communications.

The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is a control unit for controlling the various sections, such as the communication interface 70, the image memory 74, the motor driver 76, the heater driver 78, and the like. The system controller 72 is constituted by a central processing unit (CPU) and peripheral circuits thereof, and the like, and the system controller 72 controls communications with the host computer 86 and controlling reading and writing from and to the image memory 74, or the like, and also generates a control signal for controlling the motor 88 of the conveyance system and the heater 89.

The motor driver (drive circuit) 76 drives the motor 88 in accordance with commands from the system controller 72. The heater driver 78 drives the heater 89 of the post-drying unit 42 or the like in accordance with commands from the system controller 72.

The print controller 80 has a signal processing function for performing various tasks, compensations, and other types of processing for generating print control signals from the image data stored in the image memory 74 in accordance with commands from the system controller 72 so as to supply the generated print control signal (dot data) to the head driver 84. Prescribed signal processing is carried out in the print controller 80, and the ejection amount and the ejection timing of the ink droplets from the recording head 50 are controlled through the head driver 84, on the basis of the print data. By this means, prescribed dot size and dot positions can be achieved.

The print controller 80 is provided with the image buffer memory 82; and image data, parameters, and other data are temporarily stored in the image buffer memory 82 when image data is processed in the print controller 80. The aspect shown in FIG. 7 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 generates drive signals for driving the piezoelectric elements 58 (see FIG. 3) of the recording heads 50 of the respective colors on the basis of the print data supplied from the print controller 80, and it supplies the drive signals thus generated to the piezoelectric elements 58. A feedback control system for maintaining constant drive conditions for the recording heads 50 may be included in the head driver 84.

The voltage control unit 90 has the function of controlling the output voltage of the variable power source 68 in accordance with instructions from the print controller 80, and it implements control in synchronism with the drive signals for the piezoelectric elements 58, which are generated on the basis of the print data.

The print determination unit 24 is a block that includes the line sensor as described above with reference to FIG. 1, reads the image printed on the recording paper 16, determines the print conditions (presence of the ejection, variation in the dot formation, and the like) by performing desired signal processing, or the like, and provides the determination results of the print conditions to the print controller 80.

According to requirements, the print controller 80 makes various corrections with respect to the recording head 50 on the basis of information obtained from the print determination unit 24.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection apparatus, comprising:

a pressure chamber which contains liquid;

a nozzle which is connected to the pressure chamber, the liquid being ejected in an ejection direction through the nozzle;

a piezoelectric element which applies pressure change to the liquid in the pressure chamber, a part of the liquid protruding from the nozzle upon the pressure change and growing into a column of the liquid having a longitudinal direction parallel with the ejection direction;

an electrode which induces a charge on a surface of the column of the liquid; and a voltage control device which controls voltage applied to the electrode, the voltage control device reversing polarity of the electrode when the column of the liquid has grown to a prescribed length.

2. The liquid ejection apparatus as defined in claim 1, wherein the electrode is composed of a plate arranged over the nozzle and having a hole in a position corresponding to the nozzle, the hole having a tapered shape becoming gradually narrower along the ejection direction.

3. An image forming apparatus comprising the liquid ejection apparatus as defined in claim 2.

4. An image forming apparatus comprising the liquid ejection apparatus as defined in claim 1.

5. A liquid ejection method comprising the steps of:

applying pressure change to liquid in a pressure chamber by using displacement of a piezoelectric element, a part of the liquid protruding from a nozzle connected to the pressure chamber upon the pressure change and growing into a column of the liquid having a longitudinal direction parallel with an ejection direction in which the liquid is ejected through the nozzle;

applying a prescribed voltage to an electrode to induce a charge on a surface of the column of the liquid; and reversing polarity of the electrode when the column of the liquid has grown to a prescribed length.

* * * * *